US006036151A

United States Patent [19]

Förthmann

[11] Patent Number: 6,036,151

[45] Date of Patent: Mar. 14, 2000

[54] MOUNTING DEVICE FOR BOATS

[76] Inventor: Peter Förthmann, Bandwirkerstrasse 39-41, D-22041 Hamburg, Germany

[21] Appl. No.: 09/136,707

[22] Filed: Aug. 19, 1998

[30] Foreign Application Priority Data

Aug. 19, 1997 [DE] Germany ..... 297 14 722 U

[51] Int. Cl.[7] ..... E04G 3/00

[52] U.S. Cl. ..... 248/283.1; 114/343

[58] Field of Search ..... 248/289.11, 282.1, 248/283.1, 229.1, 229.2, 274.1, 276, 643, 313, 316.1; 114/343, 362

[56] References Cited

U.S. PATENT DOCUMENTS 320,941 6/1885 Macomber ..... 248/283.1 X

*Primary Examiner*—Ramon O. Ramirez

*Attorney, Agent, or Firm*—Tarolli, Sundheim, Covell, Tummino & Szabo L.L.P.

[57] ABSTRACT

A mounting device for mounting self-steering systems, bathing ladders or other accessories on the stern of boats comprising forked clamps having a front and a rear clamp limb which are integrally connected to each other at their root and which forked clamps having an opening for receiving a connecting means which exerts the clamping effect for connecting the clamp with the stern of the boat and, an elongate receiving zone for receiving and clamping a rail-like retaining element in a position such that it is matched in terms of position and angle between the clamp limb and an element or profiled bar having or forming at least one rail-like enlargement, which enlargement is matched to the elongate receiving zones of the forked clamp such that the enlargement can be inserted into the receiving zone of the forked clamp and can be adjusted and clamped fast in a position by the corresponding forked clamp.

15 Claims, 4 Drawing Sheets

MOUNTING DEVICE FOR BOATS

FIELD OF THE INVENTION

The present invention relates to a mounting device for mounting self-steering systems, bathing ladders or other accessories on the stern of boats.

BACKGROUND OF THE INVENTION

Boat sterns, especially on more sporty boats, have always shown great diversity, with configurations such as vertical, forward- or aft-raked, rounded, gently curved, pointed and the like. It has therefore been customary up to now when fitting self-steering systems, bathing ladders or other accessories to the sterns of such boats to insert a section of hardwood or the like, specially shaped to match the configuration of the stern, between the retaining component of the accessory and the stern and to mount and fix the accessory with screw bolts that pass through the accessory retaining component, the wooden spacer and appropriate holes in the transom to washers and nuts inside the boat. Preparing wooden spacers of this type is a time-consuming exercise and even if the spacer is exactly matched to the contour of the transom, the accessory retaining component will only be able to establish a tight, stress-free fit against the stern of the boat if the accessory is ultimately mounted in precisely that position on the stern for which the wooden spacer was prepared. The root of this problem, then, is that not only are most boat sterns shaped in three-dimensions, but also the progression of the shaping changes in the horizontal and vertical directions.

Considerable stress problems normally occur in any case even where the wooden spacer does allow the accessory retaining component to fit tightly against the stern of the boat. This is because the screw bolts for the accessory mounting device are all oriented approximately parallel with one another and sit with their heads resting against flat sections of the surface of the retaining element. Wooden spacers are prepared primarily to level out the horizontal and vertical curvature of the stern and provide a flat surface for the accessory retaining element. In consequence, most retaining bolts pass through the transom of the boat at an oblique rather than a right angle, and there must therefore be another levelling spacer arranged inside the boat between the locknuts and the transom to ensure that the whole pressure surface of each locknut is able to rest evenly against the inside surface of the stern of the boat.

SUMMARY OF THE INVENTION

A mounting device having the features of claim 1 is proposed as a way of mounting accessories on the stern of boats without wedging spacer components.

A mounting device of this type renders the preparation of wooden spacers or other levelling materials for both the inside and outside of the transom superfluous.

The keystone of the novel mounting device is a forked clamp having one "front" and one "rear" clamp limb. These limbs are integrally connected to each other at their root and have an opening, for example a bore, passing flush through both clamp limbs for receiving a connecting means, for example a screw bolt, which exerts the clamping effect, for connecting the clamp with the stern of the boat. Furthermore they also have, in the region of the clamp limb surfaces that face each other, an elongate receiving zone for receiving and clamping a rail-like retaining element in a predefined desired position such that it is matched in terms of position and angle.

The "front" and "rear" clamp limbs within the meaning of the invention are thus clamp limbs extending essentially parallel to each other. The opening passing flush through both clamp limbs is preferably provided in a zone between the region of the integral connection at the root of the clamp limb and the elongate receiving zone. The receiving zone is preferably close to the free ends of the clamp limbs, and of a nature such that the rail-like retaining element is prevented by positive-locking engagement from reaching or leaving the receiving zone other than by sliding in the longitudinal direction of said rail-like retaining element. In particular the receiving zone is a region of enlarged cross section between the two clamp limbs.

"Rail-like enlargements", which can be received in a clamping fashion in the receiving zone of the forked clamp, are designed as elongate rims, of enlarged cross section, of a retaining element. Here, the connection zone between the rail-like enlargement and the rest of the retaining element is of reduced cross section with respect to the rail-like enlargement such that this region fits through the open spacing gap between the two forked clamp limbs and it is possible to rotate the retaining element and the rail-like enlargement, about the longitudinal axis of the rail-like enlargement through a certain angle limited by, amongst other factors, the width of the spacing gap between the two free ends of the clamp limbs.

In particular the rail-like enlargement may be an elongate profiled bar and, as is particularly preferred, a tube whose cross section is matched to the receiving zone of the forked clamp to give only a little play. Here, the spacing gap between the two free ends of the clamp limbs can be reduced to nothing in extreme cases because the elongate profiled bar is able to protrude beyond the opening ends of the elongate receiving zone in the forked clamp and can continue in any desired position and shape at its ends to form the retaining element. It is merely necessary to ensure that it is possible during assembly to insert the profiled bar into the elongate receiving zone of the forked clamp. The elongate profiled bar or the rail-like enlargement may even be separated into two in the longitudinal direction allowing them to be inserted into the receiving zone from either opening end of the receiving zone of the forked clamp such that both sections of the rail-like enlargement can be grasped and clamped fast in the receiving zone by the clamp limb surface. This can be done using a single locking bolt or alternatively using a number of locking bolts, it of course being necessary to ensure that the number of openings in the clamp limbs for receiving connecting means corresponds to the number of bolts desired.

Since the rail-like enlargement permits rotation about the rail in the longitudinal direction, the forked clamps of the invention can be positioned with one of their two exterior faces, which are preferably parallel with each other, resting in planar contact with the outside face of the stern of the boat. This provides stress-free mounting of the accessory on the stern of the boat and, as the mounting screw bolt in this arrangement passes through the stern of the boat in the direction normal to the surface, there is no need for any component on the inside of the stern of the boat to level up the angles. Forked clamps with a single mounting opening, in particular with a centrally arranged bore, have the additional advantage that the direction of extension of the elongate receiving zone for receiving a rail-like enlargement can be rotated about the fastening bolt axis such that the position of the mounting device on the stern of the boat can also be adjusted in this direction.

The retaining elements, which are connected or formed with the accessory or can be connected with the accessory, may be specially shaped to match the accessory. However, it is also possible to use additional forked clamps according to the invention for this purpose, the forked clamps being mounted on the accessory with, for example, screw bolts. Where this is the case, the elongate receiving zone likewise receives a rail-like enlargement that is connected or integrally formed with the rail-like enlargement on the stern of the boat, preferably a steel tube, in that, for example, one and the same profiled bar, in particular a straight prolate profiled bar such as a straight tubular section, is used for the purpose. In this sense a mounting device according to the invention can be simplified at least to one profiled bar with two forked clamps, one mounted on the stern of the boat and the other mounted on the accessory and each clamping fast the profiled bar, in particular an end of the profiled bar, in a predefinable angular position. If the device is used in this way it is necessary to speak of "lateral" clamp limbs rather than "front" and "rear" clamp limbs.

The components mentioned above, claimed and described in the exemplary embodiment that are to be used according to the invention are not subject to any particular special requirements with respect to their dimensions, shape, choice of materials and technical design, so the selection criteria known in the respective area of application may be applied without restriction.

Further details, features and advantages of the subject matter of the invention may be found in the following description of the appended drawing, in which, by way of example, preferred embodiments of the mounting device for mounting self-steering systems, bathing ladders or other accessories on the stern of boats are shown and in which:

DESCRIPTION OF PREFERRED EMBODIMENTS

Figure 1:
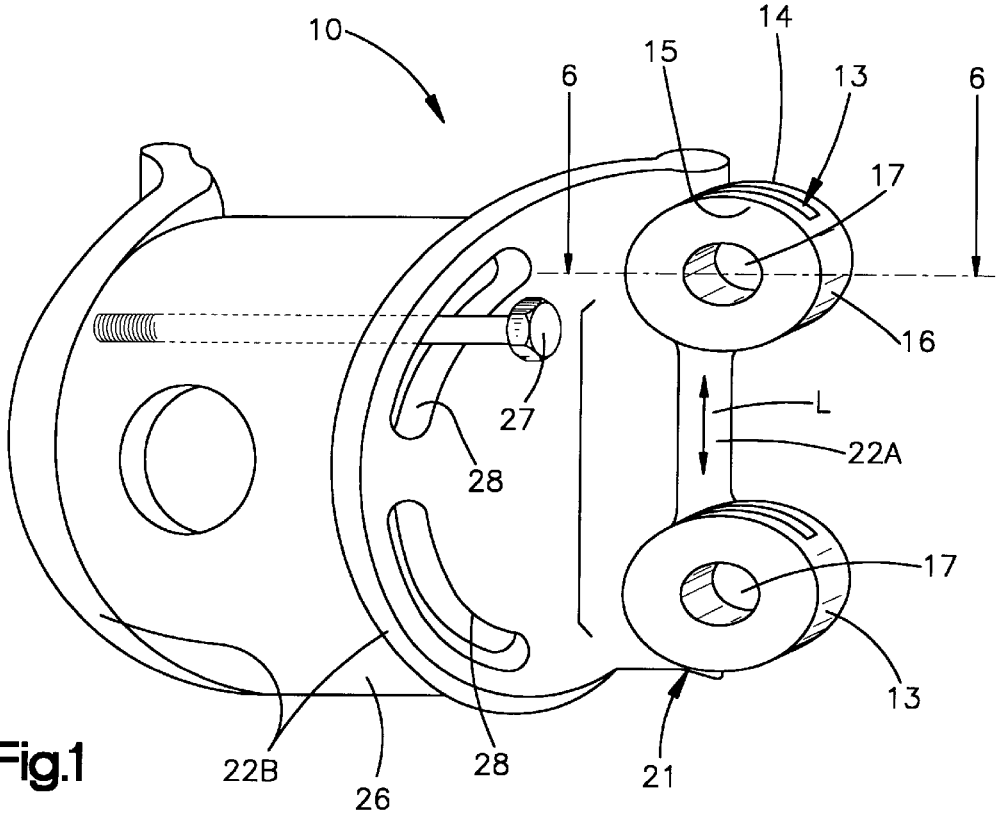
FIG. 1 shows a mounting device for mounting a self-steering system on the stern of a boat in perspective view.
Figure 2:
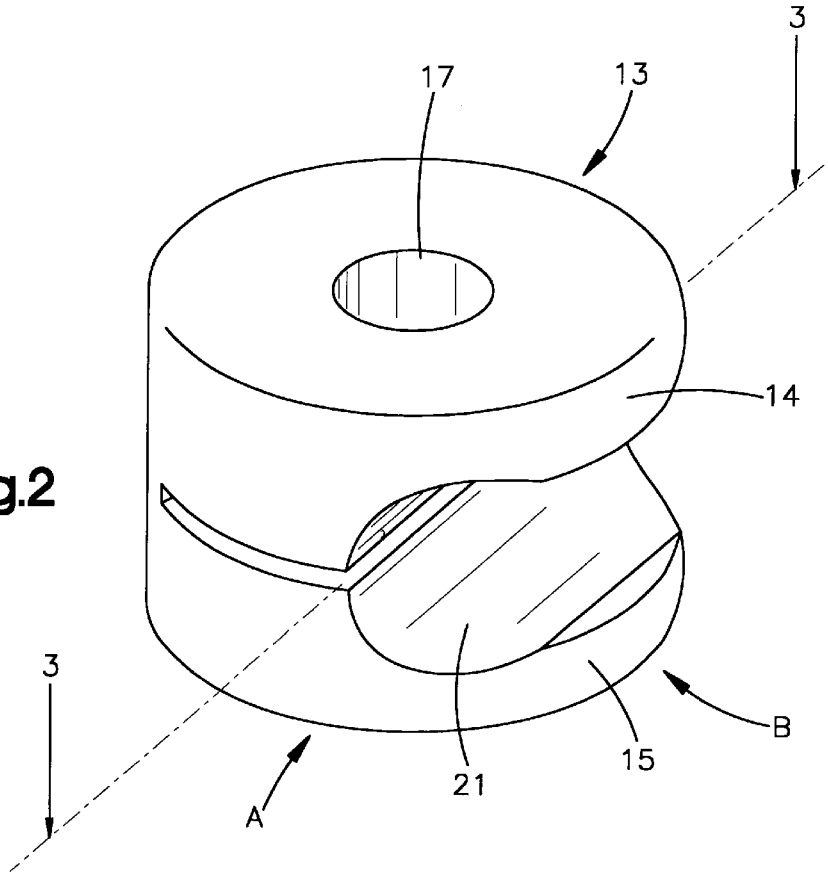
FIG. 2 shows a forked clamp for the mounting device according to FIG. 1 in perspective view.
Figure 3:
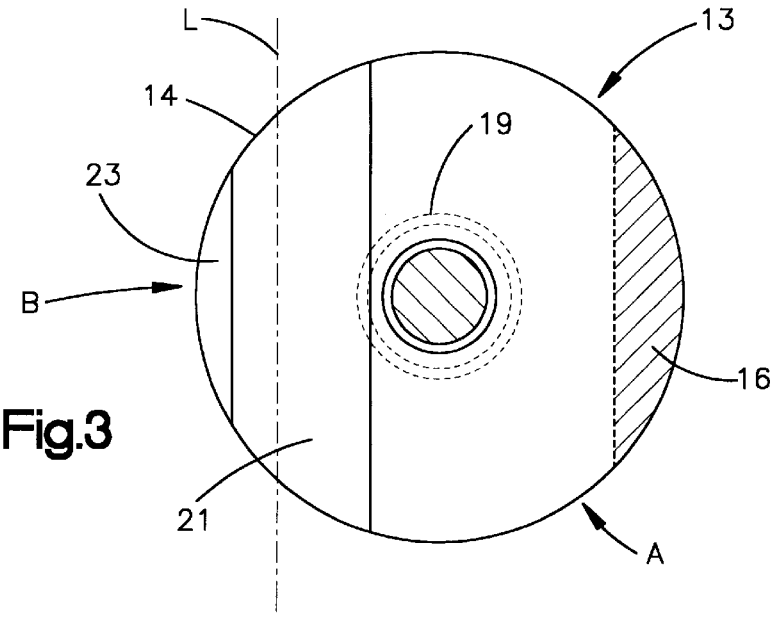
FIG. 3 shows an internal view of a clamp limb of the same clamp in section along the line 3—3 in FIG. 2 and 4.
Figure 4:
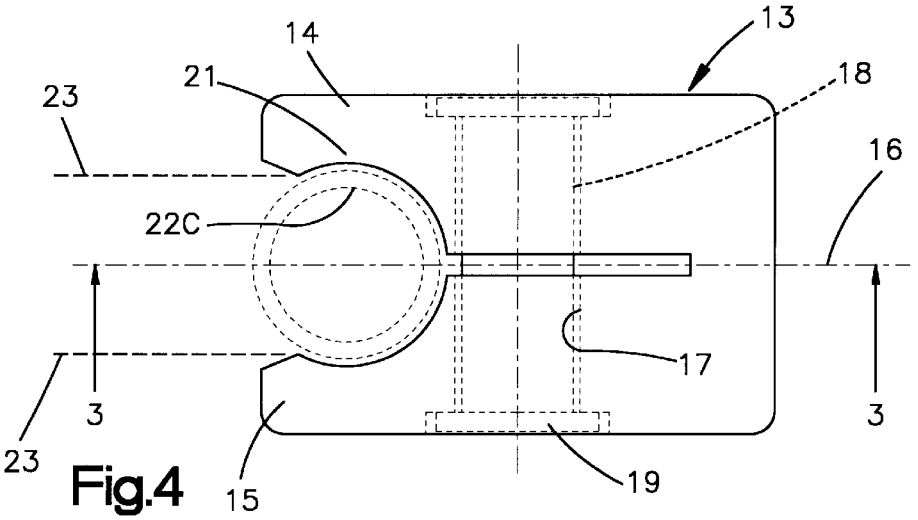
FIG. 4 shows a first side view of the same forked clamp (view A in FIGS. 2 and 3)
Figure 5:
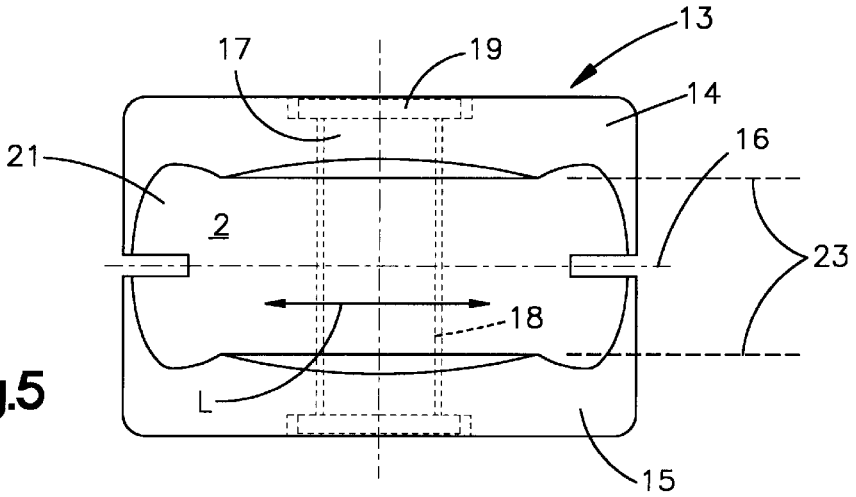
FIG. 5 shows a second side view of the same clamp (view B in FIGS. 2 and 3)
Figure 6:
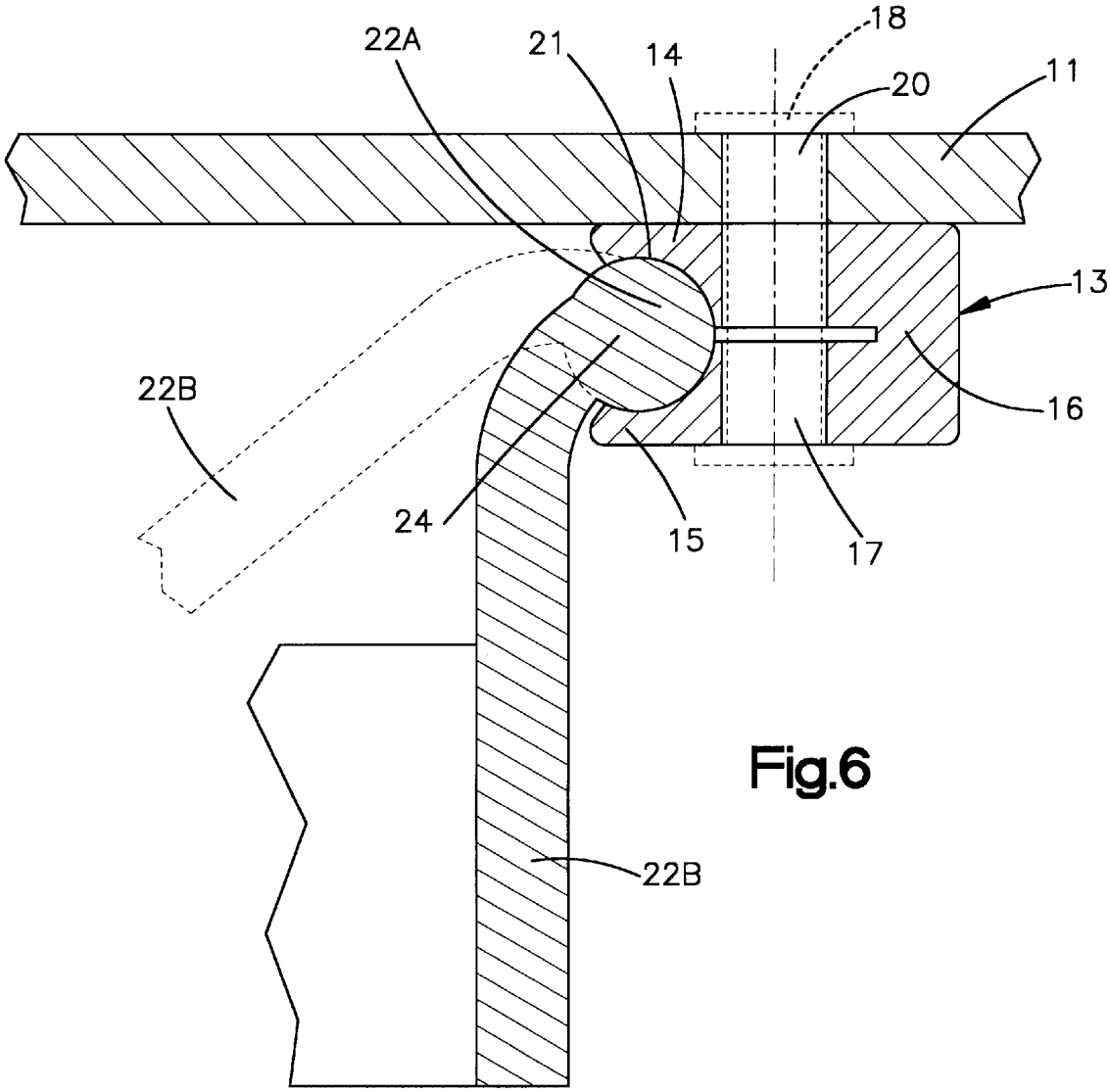
FIG. 6 shows an extract of a horizontal section through the mounting device according to FIG. 1 along line 6—6 in FIG. 1.
Figure 7:
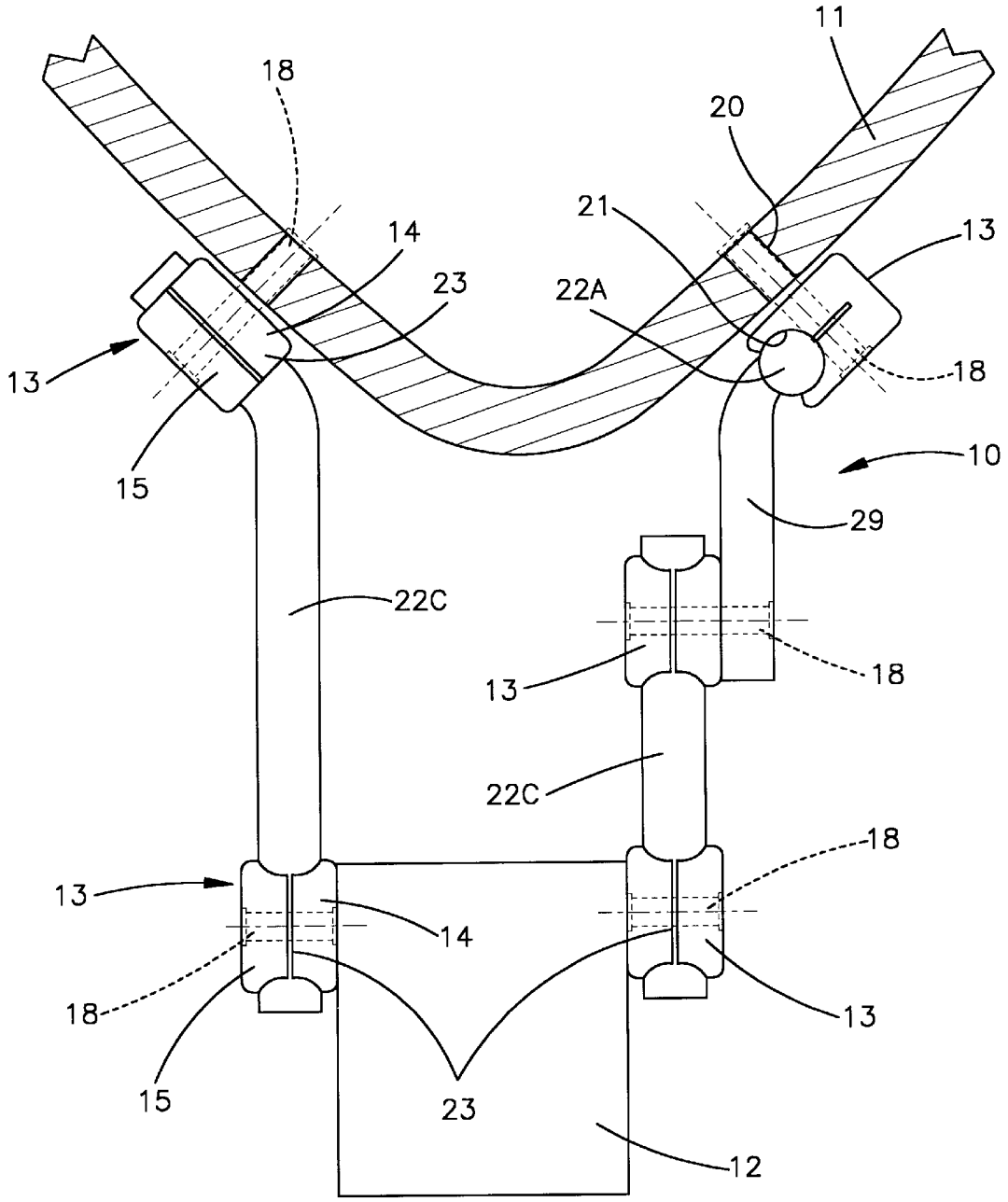
FIG. 7 shows two variants of a further embodiment of a mounting device with tubes instead of retaining element with rail-like enlargements.

FIG. 1 shows a mounting device 10 for mounting a self-steering system (not shown in the drawing) on the stern 11 of a boat (FIGS. 6 and 7). Said mounting device comprises two retaining elements (22B), each approximately at right angles (elbow piece), which two retaining elements can be connected via elongated holes 28 with a supporting structure 26, situated between them, of the self-steering system by means of fastening bolts 27, and also comprises, in the exemplary embodiment shown, for example four forked clamps 13 and two rail-like enlargements 22A of the retaining elements 22B (FIGS. 1 and 6) or of the profiled bars 22C (FIGS. 4 and 7), said retaining elements or profiled bars being matched in terms of shape with the forked clamps. The two retaining elements 22B are formed as elbow pieces whose two limbs are oriented such that the angle between them is a right or slightly obtuse angle. The limb without the elongated holes in each case has a rail-like enlargement 22A of approximately circular cross section at its free limb edge, as can be seen particularly clearly in FIG. 6. Clamps 13 (FIGS. 2 to 5), which are to be described in more detail below, can be slid onto the rail-like enlargements 22A in the long direction L of the rail. These clamps 13 may be pivoted to a limited degree, for example by no more than 45(, about the long direction L of the rail (see FIG. 6).

The clamps 13 shown in FIGS. 2 to 6 comprise two mutually approximately parallel clamp limbs 14 and 15 integrally connected at one limb-end, namely the root 16. The surfaces of the clamp limbs 14 and 15 that face each other each have an elongate receiving zone 21 close to the free ends of the clamp limbs remote from the root 16. The two receiving zones 21 are shaped and arranged with respect to each other such that together they form a receiving region for a rail-like enlargement 22A or a profiled bar 22C. This can be seen particularly clearly in FIGS. 4 and 6. The clamp limbs 14 and 15 are provided between the root 16 and the receiving zone 21 with a flush opening, for example a bore 17, which may be enlarged on the outsides of the clamp limbs 14 and 15 to give an annular receiving recess. The bores 17 and the recess 19 serve to receive a connecting means 18, for example a screw bolt. The connecting means has a double function in use. First of all it is used to screw down the clamp 13, for example on the stern 11 of a boat. This screwing down action simultaneously tensions the clamp limbs 14 and 15 against each other such that if the shapes of the elongate receiving zones 21 are correctly matched to the rail-like enlargement 22A or a profiled bar 22C, said rail-like enlargement or profiled bar is clamped fast between the two clamp limbs 14 and 15. The primary result is thus a frictional connection that fixes the clamp 13 in position relative to the rail-like enlargement 22A or profiled bar 22C both in terms of angle and in respect of the long direction L of the rail. The spacing gap 23 at the free ends of the clamp limbs 14 and 15 is preferably narrower than the greatest lateral extent of the rail-like enlargement 22A or profiled bar 22C, this resulting in an axial interengagement of clamp and enlargement and more simple mounting, and also yielding a very secure connection. The funnel-shaped widening of the gap 23 to the outside, visible in FIG. 4, ensures that the rail and rail-seat can be pivoted with respect to each other over the greatest possible range. This is illustrated in FIG. 6 by showing two extreme positions of the retaining element 22B relative to the clamp 13 (in continuous and dashed lines) and is facilitated by a narrowing 24 of the cross section of the retaining element 22B directly adjacent to the enlargement 22A. If tubes are used as the profiled bars 22C (FIG. 4), such a narrowing of the cross section is of course unnecessary and is omitted.

The spacing gap between the two clamp limbs 14 and 15 can be of more or less any desired shape in the region between the root 16 and the receiving zone 21, for example slotted as shown in the exemplary embodiments of the drawing.

As can be seen particularly clearly in FIG. 6, the clamps 13 may be pivoted considerably relative to the retaining element 22B and can be clamped in any pivot position. There is thus no need for any levelling component between the mounting device 10 and the stern of the boat 11. Moreover, the opening 17 and the bore 20, flush with said opening, in the stern of the boat always extend perpendicular to the hull of the boat, allowing stress-free mounting without any shaped levelling spacer on the inside of the boat.

FIG. 7 shows an alternative embodiment in which the same clamps 13 are also used to connect the retaining element, which may be a profiled bar 22C, to the accessory 12. The left and right sides of FIG. 7 show different installation options. The option on the left shows a profiled bar 22C, in the form of a circular tube, being used as the retaining element. The diameter of the tube is identical to that of the rail-like thickening 22A, so the tube is received by the receiving zone of the clamp 13 like a rail. The tube (profiled bar 22C) is bent to an appropriate angle to accommodate the pronounced curvature of the stern configuration shown in FIG. 7. The limbs of this tube can be of any desired length, within reasonable limits, as the free ends of the tube can protrude beyond the clamps 13 as shown in the drawing.

The option on the right uses three clamps 13 rather than two for the same mounting device, two of the three clamps being connected by a straight prolate tube (profiled bar 22C). The middle clamp 13 is bolted on the other side to an elbow piece 29, which may in principal correspond to the retaining element 22B in FIGS. 1 and 6 and which is a prefabricated standard component that is used where necessary together with the clamp 13 for mounting on the stern 11 corresponding to the embodiment shown in FIG. 6. The mounting option on the right thus uses only prefabricated standard components in the manner of a kit; there is no need to adapt any components to the particular stern configuration in question.

REFERENCE NUMBERS

10 mounting device
11 stern
12 accessory
13 clamps
14 clamp limb
15 clamp limb
16 root
17 opening
18 connecting means
19 recess
20 bore
21 receiving zone
22A enlargement
22B retaining element
22C profiled bar
23 gap
24 narrowing of the cross section
26 supporting structure
27 fastening bolts
28 elongated holes
L long direction of the rail

I claim:

1. Mounting device for mounting accessories on the stern of boats comprising:

at least one forked clamp having a front clamp limb with a first clamp surface and a rear clamp limb with a second clamp surface;

said forked clamp further including a root which integrally connects said front and rear clamp limbs;

an elongate receiving zone for receiving and clamping a rail-like retaining element in a desired position and angle in between said first and second clamp surfaces;

said retaining element forming at least one rail-like enlargement having a long direction, said enlargement further having a cross-section which is matched with the cross-section of the elongate receiving zone, said forked clamp having at least one opening passing through said front and rear clamp limbs, and a connecting means for extending through said opening for connecting said forked clamp to the stern of a boat.

2. Mounting device as defined in claim 1 wherein said first an second clamp limb surfaces are essentially polygonal in form.

3. Mounting device as defined in claim 1 wherein said first an second clamp limb surfaces are essentially round in form.

4. Mounting device as defined in claim 1 wherein said opening of said forked clamp passes through the central portion of said front and rear clamp limbs.

5. Mounting device as defined in claim 1 wherein said opening is arranged between said elongate receiving zone and said root of said forked clamp.

6. Mounting device as defined in claim 1 further comprising a spacing gap being located between said root and said front and rear clamp limbs of said forked clamp.

7. Mounting device as defined in claim 1 wherein said enlargement can be inserted into the receiving zone of said forked clamp, can be adjusted in terms of its angular position about said long direction of the rail and can be clamped in a desired position by an additional forked clamp.

8. Mounting device for mounting accessories on the stern of boats comprising:

at least one forked clamp having a front clamp limb with a first clamp surface and a rear clamp limb with a second clamp surface;

said forked clamp further including a root which integrally connects said front and rear clamp limbs;

said forked clamp further including an elongate receiving zone for receiving and clamping a profiled bar in a desired position and angle in between said first and second clamp surfaces, said profiled bar forming at least one rail-like enlargement having a longitudinal direction, said enlargement further having a cross-section which is matched with the cross-section of the elongate receiving zone;

said forked clamp further having at least one opening passing through said front and rear clamp limbs, and a connecting means for extending through said opening for connecting said forked clamp to the stern of a boat.

9. Mounting device as defined in claim 8 wherein said profiled bar comprises a tube.

10. Mounting device as defined in claim 8 wherein said first an second clamp limb surfaces are essentially polygonal in form.

11. Mounting device as defined in claim 8 wherein said first an second clamp limb surfaces are essentially round in form.

12. Mounting device as defined in claim 8 wherein said opening of said forked clamp passes through the central portion of said front and rear clamp limbs.

13. Mounting device as defined in claim 8 wherein said opening is arranged between said elongate receiving zone and said root of said forked clamp.

14. Mounting device as defined in claim 8 further comprising a spacing gap being located between said root and said front and rear clamp limbs of said forked clamp.

15. Mounting device as defined in claim 8 wherein said enlargement can be inserted into the receiving zone of said forked clamp, can be adjusted in terms of its angular position about said long direction of the rail and can be clamped in a desired position by an additional forked clamp.

* * * * *